United States Patent [19]

Kimbrough et al.

[11] 4,194,463

[45] Mar. 25, 1980

[54] APPARATUS FOR APPLYING SEALING MATERIAL TO A CATHODE-RAY TUBE

[75] Inventors: Laurence B. Kimbrough; Marinus Van Renssen, both of Lancaster, Pa.

[73] Assignee: RCA Corporation, New York, N.Y.

[21] Appl. No.: 927,611

[22] Filed: Jul. 24, 1978

[51] Int. Cl.[2] ..... B05C 5/02

[52] U.S. Cl. ..... 118/409; 118/321; 118/411

[58] Field of Search ..... 118/320, 321, 409, 323, 118/315, 411

[56] References Cited

U.S. PATENT DOCUMENTS

| | | | |
|---|---|---|---|
| 3,331,354 | 7/1967 | Roland | 118/320 |
| 3,339,522 | 9/1967 | Shaffer et al. | 118/321 X |
| 3,456,615 | 7/1969 | Zander et al. | 118/321 X |
| 3,492,146 | 1/1970 | Kornaker | 427/72 |
| 3,701,674 | 10/1972 | Kimbrough | 427/72 |
| 3,759,735 | 9/1973 | Pekosh | 427/64 |
| 4,069,354 | 1/1978 | Pekosh | 427/64 |

FOREIGN PATENT DOCUMENTS

| | | | |
|---|---|---|---|
| 1192693 | 4/1959 | France | 118/320 |

*Primary Examiner*—John P. McIntosh

*Attorney, Agent, or Firm*—Eugene M. Whitacre; Glenn H. Bruestle; Dennis H. Irlbeck

[57] ABSTRACT

The apparatus for applying a bead of sealing material to a sealing surface of various size cathode-ray tube funnels comprises two stations. Each station is automatically adaptable for receiving different size cathode-ray tube funnels and includes means for raising and lowering the funnel. Included is a carriage moveable between the two stations. The carriage has means for distributing a bead of sealing material and means for vertically locating the position of a tube funnel.

1 Claim, 2 Drawing Figures

APPARATUS FOR APPLYING SEALING MATERIAL TO A CATHODE-RAY TUBE

BACKGROUND OF THE INVENTION

The invention relates to an apparatus for applying a bead of sealing material to a sealing surface of a cathode-ray tube and particularly, to a dual position frit applicator for applying frit to sealing surfaces of color-television picture tubes.

In manufacturing some cathode-ray tubes, a bead of sealing material or frit is applied to the sealing surface of a funnel, a faceplate panel is placed on top of the bead, and the assembly is heated to melt the frit and seal the faceplate panel to the funnel. A typical state of the art apparatus for applying frit is disclosed in U.S. Pat. No. 3,701,674 issued to L. B. Kimbrough on Oct. 31, 1972. Although Kimbrough apparatus performs its frit application function well, it is desirable to increase its production rate as measured in tube funnels processed per hour and to apply frit to different size funnels interchangeably. Perhaps the greatest limiting factor to increased production rate with the prior art Kimbrough apparatus is that the apparatus must remain inoperative during loading and unloading of the cathode-ray tube funnels. Furthermore, various parts of the apparatus must be changed in order to handle different size funnels. Therefore, there is a need for a frit applicating apparatus which will overcome these limiting factors and thus yield an increased production rate.

SUMMARY OF THE INVENTION

An apparatus for applying a bead of sealing material to a cathode-ray tube funnel comprises two stations. Each station is adapted for receiving cathode-ray tube funnels of various sizes and includes means for raising and lowering a cathode-ray tube funnel. A carriage is also included which is moveable between the two stations. The carriage has means for distributing a bead of sealing material and means for vertically locating the position of a cathode-ray tube funnel.

DESCRIPTION OF THE PREFERRED EMBODIMENT

Figure 1:
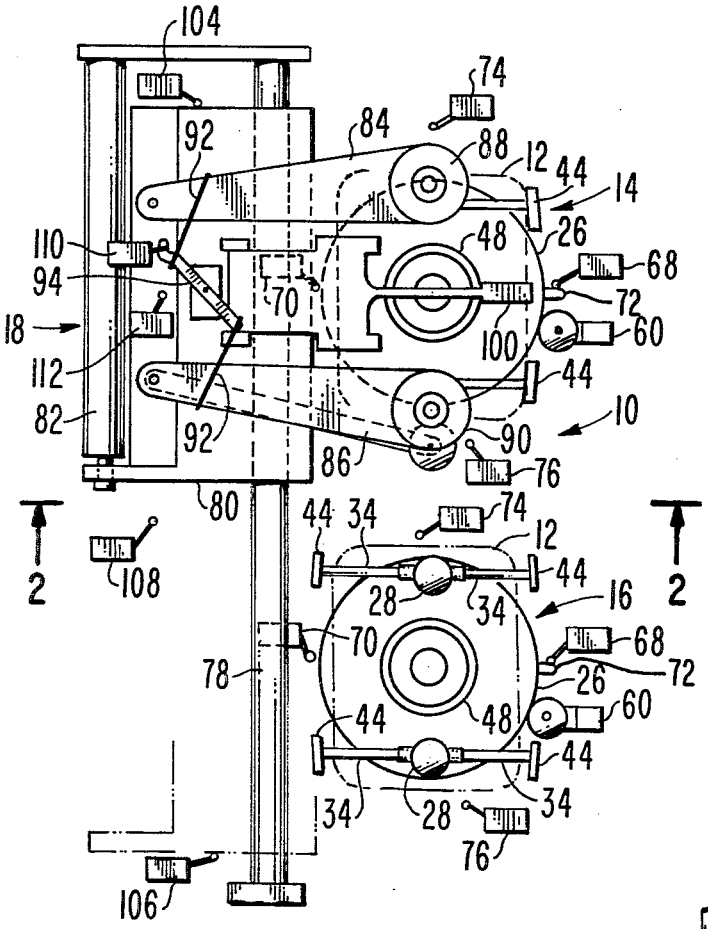
FIG. 1 is a plan view of a dual position frit applicator.
Figure 2:
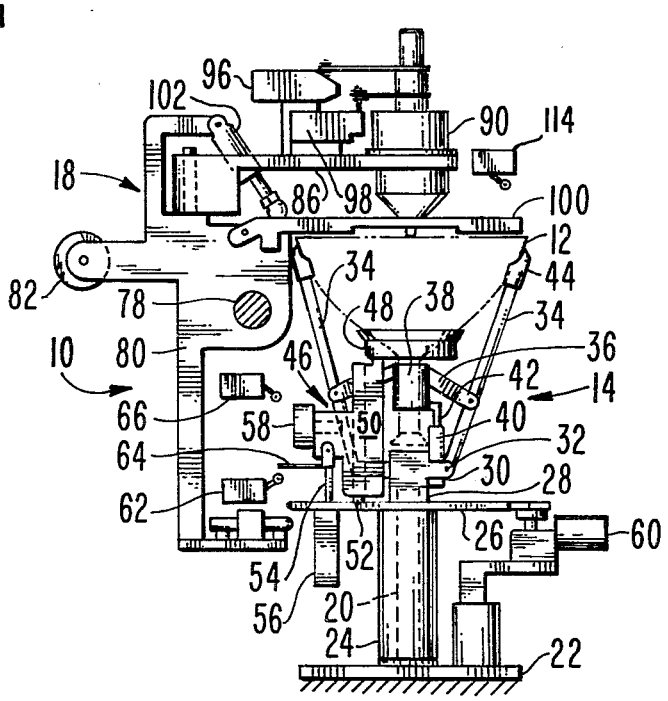
FIG. 2 is a side elevational view of the applicator of FIG. 1 on the section line 2—2.

FIGS. 1 and 2 illustrate a novel apparatus 10 for applying sealing material to a cathode-ray tube funnel 12. Such an apparatus is generally known in the art as a "frit applicator." Basic components of the apparatus 10 are two separated spindle stations 14 and 16 which are adapted for receiving cathode-ray tube funnels and a carriage unit 18, including sealing material dispensing devices, which is moveable between the two stations 14 and 16.

The drawings of FIGS. 1 and 2 are simplified representations of an apparatus that incorporates the present invention. Most subassemblies of an operating apparatus may be constructed in accordance with the embodiment disclosed in the previously mentioned U.S. Pat. No. 3,701,674. Therefore, for the purpose of including such subassembly detail, U.S. Pat. No. 3,701,674 is hereby incorporated by reference.

Each station, 14 and 16, comprises a fixed shaft 20 extending vertically from a rigid foundation 22. A sleeve 24 is fitted onto the shaft 20 such that the sleeve 24 is free to rotate about the vertical axis of the shaft 20. Preferably the sleeve 24 and shaft 20 are separated by ball bearings (not shown) to reduce friction therebetween. A horizontally positioned disc-shaped platform 26 is attached to the upper end of the sleeve 24. This platform 26 serves as a base for other station components as well as a drive wheel for the station. Two support members 28 are rigidly affixed to the top surface of the platform 26 at opposite points near its periphery. Each of these members 28 has two opposite facing projections 30 which serve as pivot points 32 for two locating pad arms 34 which are free to rotate about the pivot points 32. The pairs of arms 34 are connected to each other via two linkage members 36 which are pivotly attached to each arm 34 and are interconnected to each other by a connector 38. The connectors 38 are vertically moveable by pneumatic cylinders 40 which are mounted on the support members 28 and have their piston rods 42 connected to the connector 38. Extension of the piston rods 42 raises the connector 38 thus causing the linkage members 36 to move up and pull the arms 34 together. This linkage is designed to give an equalizing motion to insure accurate centering. Vacuum locating pads 44 are affixed to the upper rod of each arm 34. It is the purpose of these pads to hold the tube funnel and to horizontally position the funnel.

A funnel raising and lowering assembly 46 is also positioned on the platform 26. This assembly 46 comprises an annular-shaped vacuum funnel holder 48 which is centered relative to the platform 26 and is contoured to securely hold a funnel. An interconnecting member 50 is attached to the holder 48. This member 50 is slidably mounted on a vertical shaft 52. A piston arm 54 of a raising and lowering pneumatic cylinder 56 is attached to the member 50 so that the member 50 and the attached holder 48 may be moved vertically. A locking device 58 is also attached to the member 50 so that the funnel holder 48 can be locked in its up position for application of the frit material. Each platform 26, and all of the components attached thereto, are rotated by peripheral drive units 60 which engage the rims of the platforms 26. An alternate preferable drive system is shown in U.S. Pat. No. 3,701,674.

In order to control the operation of each station, a plurality of switches are positioned at locations about the stations to sense various station modes. A first switch 62 is oriented to sense the position of the funnel holder 48 when no funnel is present in the station. This switch 62 is tripped by a rod 64 extending from the piston arm 54. Another switch 66, located above the switch 62, senses the presence of the holder 48 at its upper position with the piston arm 54 extended from the cylinder 56. Two other switches 68 and 70 are located to sense rotation of the platform 26. These switches 68 and 70 are activated by an arm 72 on the platform 26 and are located 185° apart so that there will be some overlap during frit application. Two further switches 74 and 76 are located at each station to sense the corners of the funnel so that the speed of the drive unit 60 can be automatically adjusted to ensure even distribution of frit around the corners.

The carriage unit 18 includes a rail 78 extending adjacent the two stations 14 and 16, a travelling carriage 80 slidably mounted on the rail 78 and a pneumatic cylinder 82 for moving the carriage between the two stations. Two frit pot support arms 84 and 86 are rotatably attached to the carriage 80. Each of these arms 84 and 86 has a frit dispensing container, 88 and 90, respectively, positioned at the end thereof. The two arms 84 and 86 are interconnected by two linkages 92 attached to a rotatable lever 94. Rotation of the lever 94 causes the two arms 84 and 86 to either move horizontally toward each other or horizontally apart. Each frit container 88 and 90 has two electric drive motors 96 and 98, as shown in FIG. 2. A DC motor 96 provides power for feeding the frit to the container outlet to ensure uniform distribution and an AC motor 96 provides power for stirring the frit within each container.

A funnel locator 100 is pivotally mounted on the carriage 80 between the two arms 84 and 86. This locator 100 is raised and lowered by a pneumatic cylinder 102 also attached to the carriage 80. The purpose of the locator 100 is to positively establish the vertical location of the tube funnel seal edge or sealing surface when it is raised, and to ensure that the sealing edge of the funnel is horizontal before frit application. Such positioning is important if uniform application of frit is to be achieved and for interchangeability of different size funnels on the apparatus. Prior art frit applicators established the position of the sealing edge by holding the funnel at the yoke mounting location. Since the sealing edge to yoke mounting location may vary somewhat from tube to tube, the prior art applicator often improperly applied frit to the sealing edge. The vertical locating or indexing function of the present apparatus overcomes this prior art disadvantage and permits frit applications to different size funnels without substantially changing the apparatus.

Operation of the carriage assembly 18 also requires the use of several switches. Two switches 104 and 106 are located to sense the location of the carriage 80 at the first and second stations, respectively. Another switch 108, located between these two, senses movement of the carriage 80 between the two stations. Two switches 110 and 112 are positioned to be activated by rotation of the lever 94 thereby sensing whether the arms 84 and 86 are either in position over a funnel or in their open positions, respectively. Yet another switch 114 is located to sense the upward position of the funnel locator 100.

Operation of the apparatus 10 is continuous in that while a funnel is unloaded and another funnel is loaded in a station, frit is being applied to yet another funnel in the other station. For a particular funnel, operation begins when the funnel is loaded in the funnel holder 48 and the apparatus operator starts the automatic cycle by activating two starting switches. As the automatic cycle starts, the arms 34 are activated momentarily to place the locating pads 44 into contact with the funnel to horizontally position the funnel. After the funnel has been horizontally positioned, the pads 44 are retracted from the funnel. At this point, the carriage 80 is moved to the station holding the new funnel by activation of the pneumatic cylinder 82. The vertical locator 100 is now lowered by activation of the pneumatic cylinder 102 and the funnel is raised by activation of the pneumatic cylinder 56 until the edge of the funnel firmly contacts the locator 100. At the same time, the locating pads 44 are again moved against the funnel. During the vertical indexing step, the vacuum applied by the funnel holder 48 is momentarily released so that the funnel can shift to accomodate the indexing position of the locator 100. Once the funnel is vertically indexed and held by the locating pads 44, the locator 100 is raised away from the funnel and the frit containers 88 and 90 are swung into positions over the funnel sealing edge by rotation of the lever 94. The drive unit 60 and the frit feed motors 96 are now simultaneously activated to rotate the funnel and to apply frit to two areas of the funnel seal edge. Rotation of the funnel continues with each container applying frit to half the seal edge until the switch 70 senses that the funnel has rotated through 185 degrees. The extra five degree rotation creates small overlaps to ensure that there is no gap in frit application. The extra frit then may be cleared away by an apparatus operator if necessary. Once the funnel has completed the 185 degree rotation, the drive unit 60 and the frit feed motors 96 are stopped and the containers 88 and 90 are swung away from the funnel. The locating pads 44 now are retracted, and the funnel is lowered while the platform 26 is rotated back to its starting position. At this point, the carriage 80 is ready to move to the next station if a new funnel has been loaded where the foregoing process will be repeated for the new funnel.

Because of the vertical locating and horizontal positioning capability of the apparatus 10, various size funnels can be interchangeably accommodated on the apparatus. When different size funnels are present, the apparatus operator must manually select the proper preset rotational speed for the drive unit 60 since the outputs of the frit dispensing containers are kept constant.

What is claimed is:

1. An apparatus for applying a bead of sealing material to a sealing surface of a cathode ray tube funnel comprising:

two stations, each adaptable for receiving cathode ray tube funnels of various sizes, each station including a plurality of locating pads for holding and horizontally positioning a tube funnel and means for raising and lowering a cathode ray tube funnel, and a carriage moveable between said two stations, said carriage including means for distributing a bead of sealing material and means for vertically locating the position of a cathode-ray tube funnel comprising a funnel locator pivotally mounted on the carriage for providing positive contact with the funnel sealing surface when the funnel is raised thereagainst.

* * * * *